US006890178B2

(12) United States Patent
Gouko et al.

(10) Patent No.: US 6,890,178 B2
(45) Date of Patent: May 10, 2005

(54) DIGITAL PISTOL

(75) Inventors: Junichi Gouko, Tokyo (JP); Hiroshi Watanabe, Tokyo (JP)

(73) Assignee: NEC Corporatiion, Tokyo (JP)

( * ) Notice: Subject to any disclaimer, the term of this patent is extended or adjusted under 35 U.S.C. 154(b) by 0 days.

(21) Appl. No.: 10/685,436

(22) Filed: Oct. 16, 2003

(65) Prior Publication Data

US 2004/0123508 A1 Jul. 1, 2004

(30) Foreign Application Priority Data

Oct. 28, 2002 (JP) ..... 2002-312580

(51) Int. Cl.[7] ..... F41G 3/26

(52) U.S. Cl. ..... 434/19; 42/54; 73/167; 273/311; 273/312; 273/313; 434/21; 434/22

(58) Field of Search ..... 42/54; 73/167; 273/311, 312, 313; 434/21, 22, 19

(56) References Cited

U.S. PATENT DOCUMENTS 2,077,383 A * 4/1937 Folsy ..... 463/52
3,748,751 A * 7/1973 Breglia et al. ..... 434/21
3,811,204 A * 5/1974 Marshall et al. ..... 434/22
3,847,396 A * 11/1974 Ashford ..... 434/16
3,889,396 A * 6/1975 Aronson ..... 434/20
3,996,674 A * 12/1976 Pardes et al. ..... 434/22
4,019,262 A * 4/1977 Breglia et al. ..... 434/20
4,086,711 A * 5/1978 Gammarino et al. ..... 434/22
4,229,009 A * 10/1980 Ohta ..... 463/52
4,395,045 A * 7/1983 Baer ..... 463/5
4,545,583 A * 10/1985 Pearman et al. ..... 463/5
4,619,616 A * 10/1986 Clarke ..... 434/22
4,629,427 A * 12/1986 Gallagher ..... 434/22
4,640,514 A * 2/1987 Myllyla et al. ..... 463/51
4,657,511 A * 4/1987 Allard et al. ..... 434/20
4,662,845 A * 5/1987 Gallagher et al. ..... 434/22
4,695,058 A * 9/1987 Carter et al. ..... 463/5
4,844,476 A * 7/1989 Becker ..... 463/5
4,898,391 A * 2/1990 Kelly et al. ..... 463/5
4,948,371 A * 8/1990 Hall ..... 434/21
5,059,150 A 10/1991 Kuo
5,366,229 A * 11/1994 Suzuki ..... 463/5
5,375,847 A * 12/1994 Fromm et al. ..... 463/5
5,577,962 A * 11/1996 Kounoe et al. ..... 463/49
5,816,817 A * 10/1998 Tsang et al. ..... 434/22
6,012,980 A * 1/2000 Yoshida et al. ..... 463/2
6,110,039 A * 8/2000 Oh ..... 463/2
6,323,838 B1 * 11/2001 Thanasack et al. ..... 345/156
6,328,651 B1 * 12/2001 Lebensfeld et al. ..... 463/52
6,616,452 B2 * 9/2003 Clark et al. ..... 434/19
6,663,391 B1 * 12/2003 Otowa ..... 434/16

FOREIGN PATENT DOCUMENTS

DE 195 19 503 A1 12/1995
JP 7-174493 7/1995

* cited by examiner

*Primary Examiner*—Peter M. Poon
*Assistant Examiner*—John Richardson
(74) *Attorney, Agent, or Firm*—Young & Thompson

(57) ABSTRACT

A gun suitable for games is disclosed for permitting an operator to recognize when a trigger is pulled. A target signal receiver receives a target signal sent from a target for causing the gun to recognize that the gun is opposite the target, and notifies a controller that the target signal receiver has received the target signal. Upon detection of a manipulation by the operator, the controller a forces shooting device to perform a shooting operation, and instructs an information generator to generate recognition information. The shooting device emits an optical bullet formed of a light ray. The recognition information generator drives a solenoid to bring associated members into impact against each other to permit the operator to recognize that the operation has been performed.

10 Claims, 6 Drawing Sheets

DIGITAL PISTOL

BACKGROUND OF THE INVENTION

1. Field of the Invention

The present invention relates to a gun for use in games and other applications.

2. Description of the Related Art

The shooting is conventionally known as one of sporting events, as well as it is used by the army or the police. In ordinary shooting games, players typically fire live bullets toward a target to compete for the accuracy in a point on the target the bullets hit on the target. Guns for firing live bullets are classified as one which relies on explosion of gunpowder or as one which relies on pressure generated by a compressed air.

It is desired however to use ray guns in shooting games instead of real guns, which require sufficient attention in handling, from a viewpoint of safety. Known ray guns include a gun for games which emits flash light, and a gun for practice which is used in combination with a computer to display hit points. In addition to those for games, there are also simplified ray guns for use as toys.

A real gun fires a live bullet by mechanically actuating a hammer or an equivalent member. Likewise, some ray guns turn on/off an electronic switch for mechanically actuating a like member to emit a light ray in a manner similar to a real gun, as disclosed in JP-07-174493-A.

Some of such mechanically triggered guns require a preparatory manipulation which involves pulling the hammer or lever before firing a live bullet or emitting a light ray. This manipulation not only prevents continuous shooting but also makes it difficult for one-armed persons to use the mechanical gun.

In contrast, there is an electronically triggered ray gun which turns on/off an electronic switch without intervention of a hammer or an equivalent member. Since this type of ray gun eliminates the need for manipulating the hammer or lever before emitting a light ray, it facilitates continuous shooting and permits one-armed persons to readily manipulate the ray gun.

While the electronically triggered ray gun can facilitate continuous shooting and permit one-armed persons to readily manipulate the same, the ray gun does not generate sound or shock when it emits a light ray. Disadvantageously, the ray gun blunts the sensibility of players in games and the like because the players cannot recognize the emission of light ray when they pull the trigger. The same is true for air rifles and the like which hardly generate sound or reaction upon shooting a live bullet so that players experience difficulties in recognizing the firing of the live bullet.

SUMMARY OF THE INVENTION

It is an object of the present invention to provide a gun which is capable of permitting an operator to recognize when he pulls a trigger.

To achieve the above object, the gun according to the present invention includes manipulating means manipulated by an operator, and shooting means for performing a shooting operation in response to a manipulation of the manipulating means, and further has control means and recognition information generating means.

The control means is configured to detect a manipulation made by the operator to the manipulating means, and upon detection of the manipulation, controls the recognition information generating means to generate recognition information. The recognition information generating means generates the recognition information for permitting the operator to recognize that to the manipulating means has been operated.

Thus, according to the present invention, upon detection of an operation of the manipulating means, the recognition information generating means generates the recognition information in response to a control signal from the control means which has detected the operation, thereby permitting the operator to recognize the manipulation.

Also, the recognition information generating means may include a solenoid, and drive the solenoid in response to a control signal from the control means to bring associated members into impact against each other, thereby generating the recognition information.

Thus, upon detection of an operation of the manipulating means, the recognition information generating means drives the solenoid in response to the control signal from the control means to bring the associated members into impact against each other to generate the recognition information, permitting the operator to recognize the manipulation through sound and/or vibrations.

The above and other objects, features, and advantages of the present invention will become apparent from the following description with reference to the accompanying drawings which illustrate examples of the present invention.

EMBODIMENTS

One embodiment of the present invention will hereinafter be described in detail with reference to the accompanying drawings. Illustrated herein is a laser-based shooting system for a game or for practice in preparation for the game.

Figure 1:
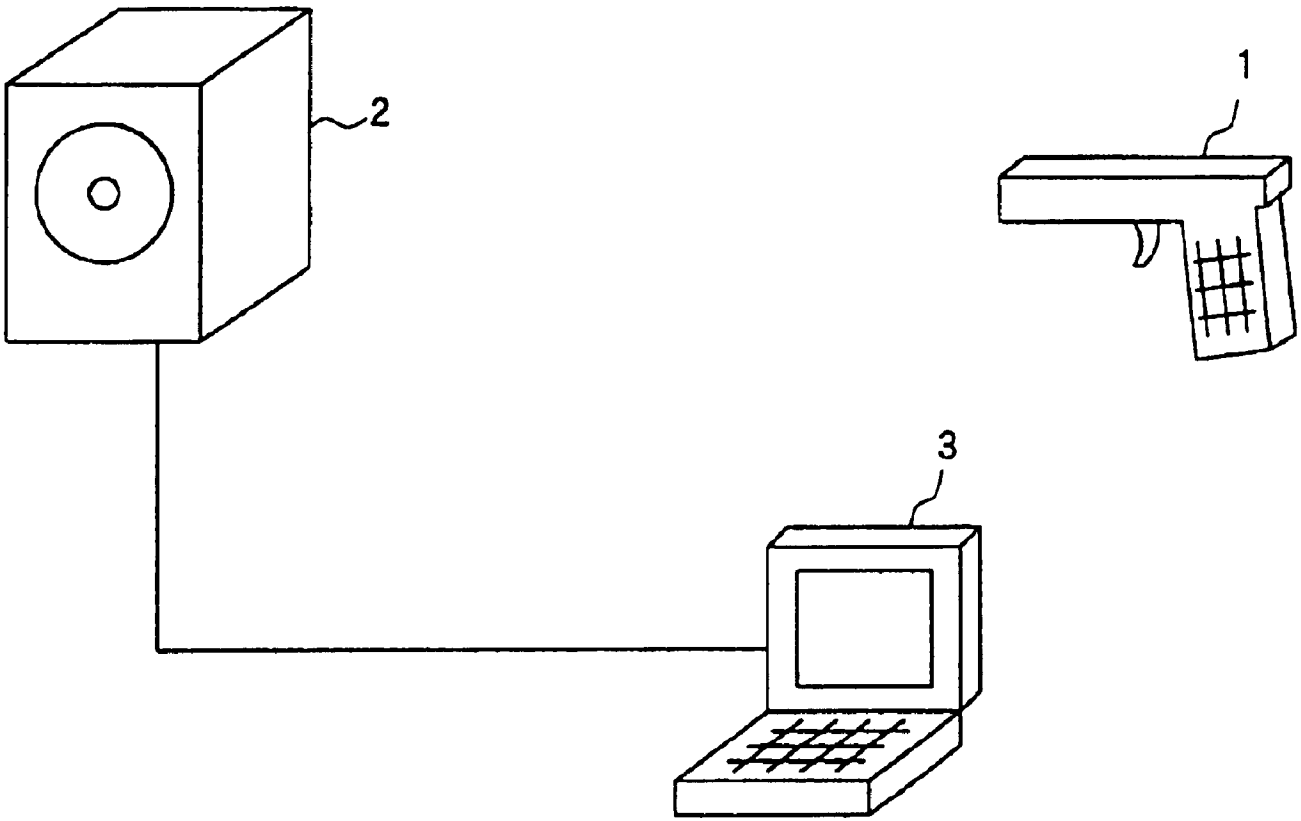
FIG. 1 is a schematic diagram illustrating the configuration of a shooting system according to one embodiment.

FIG. 1 is a schematic diagram illustrating the configuration of the shooting system according to this embodiment. Referring to FIG. 1, the shooting system comprises ray gun 1, target device 2, and display device 3.

Ray gun 1 emits a laser-based optical bullet toward target device 2 in response to an appropriate manipulation of a player. The optical bullet is a laser signal which is emitted from ray gun 1 in stead of a live bullet in a real gun. The optical bullet is emitted when the player pulls a trigger of ray gun 1.

Target device 2 detects a hit point of the optical bullet emitted from ray gun 1. Target device 2 also generates an infrared-based timing signal over a predetermined angular range in front in order for ray gun 1 to recognize that it opposes target device 2.

Display device 3 displays hit points on target device 2 of optical bullets emitted from ray gun 1, a score calculated from the hit points, and the like.

Figure 2:
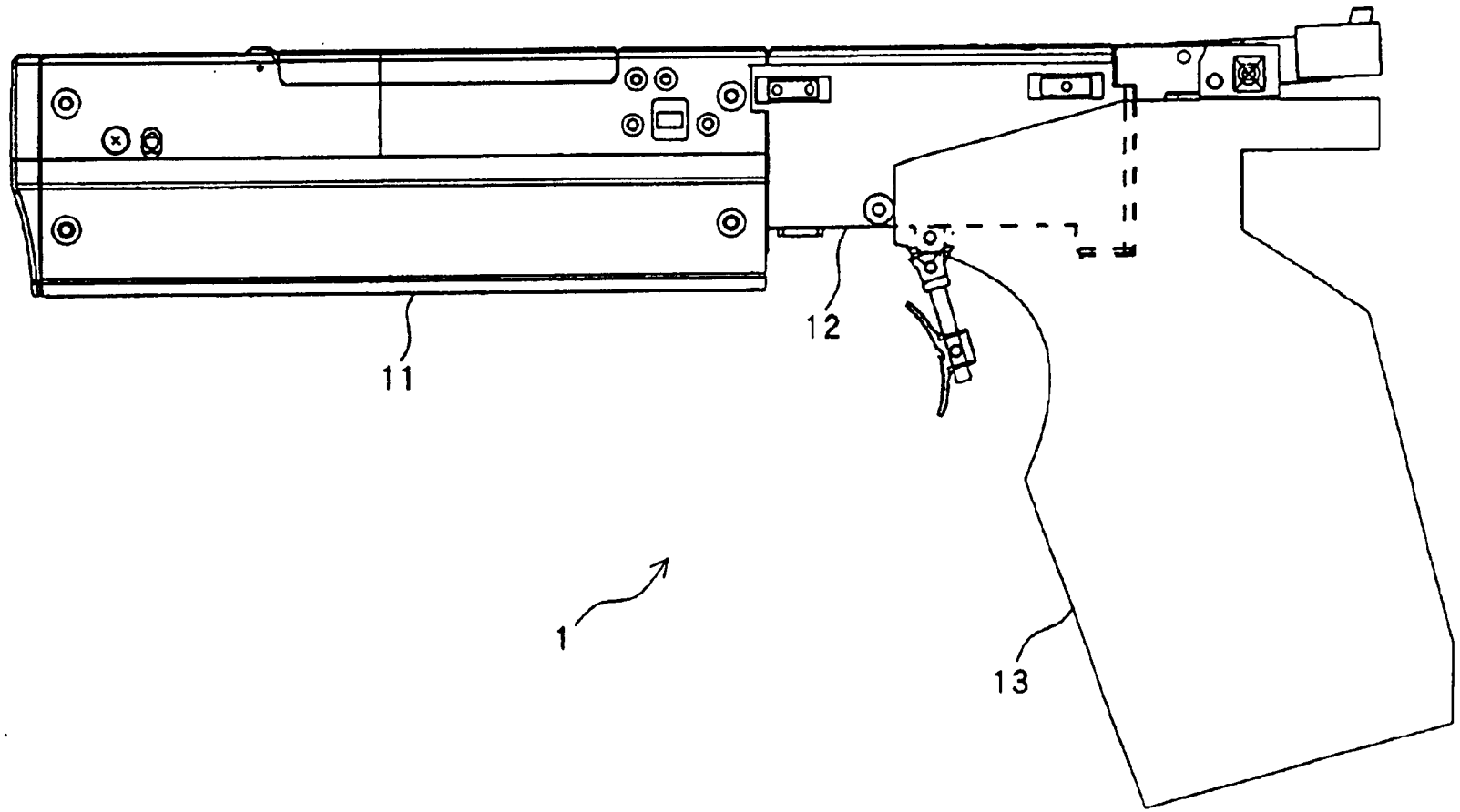
FIG. 2 is a partially sectional side view generally illustrating the structure of a ray gun.

FIG. 2 generally illustrates the structure of ray gun 1. Referring to FIG. 2, ray gun 1 comprises light source 11, frame 12, and grip 13.

Light source 11 is positioned in a portion corresponding to a barrel of a real gun. Frame 12 contains a trigger, and pertinent parts associated therewith in response to a manipulation of the trigger. Grip 13 is a portion grabbed by the player for shooting.

Figure 3:
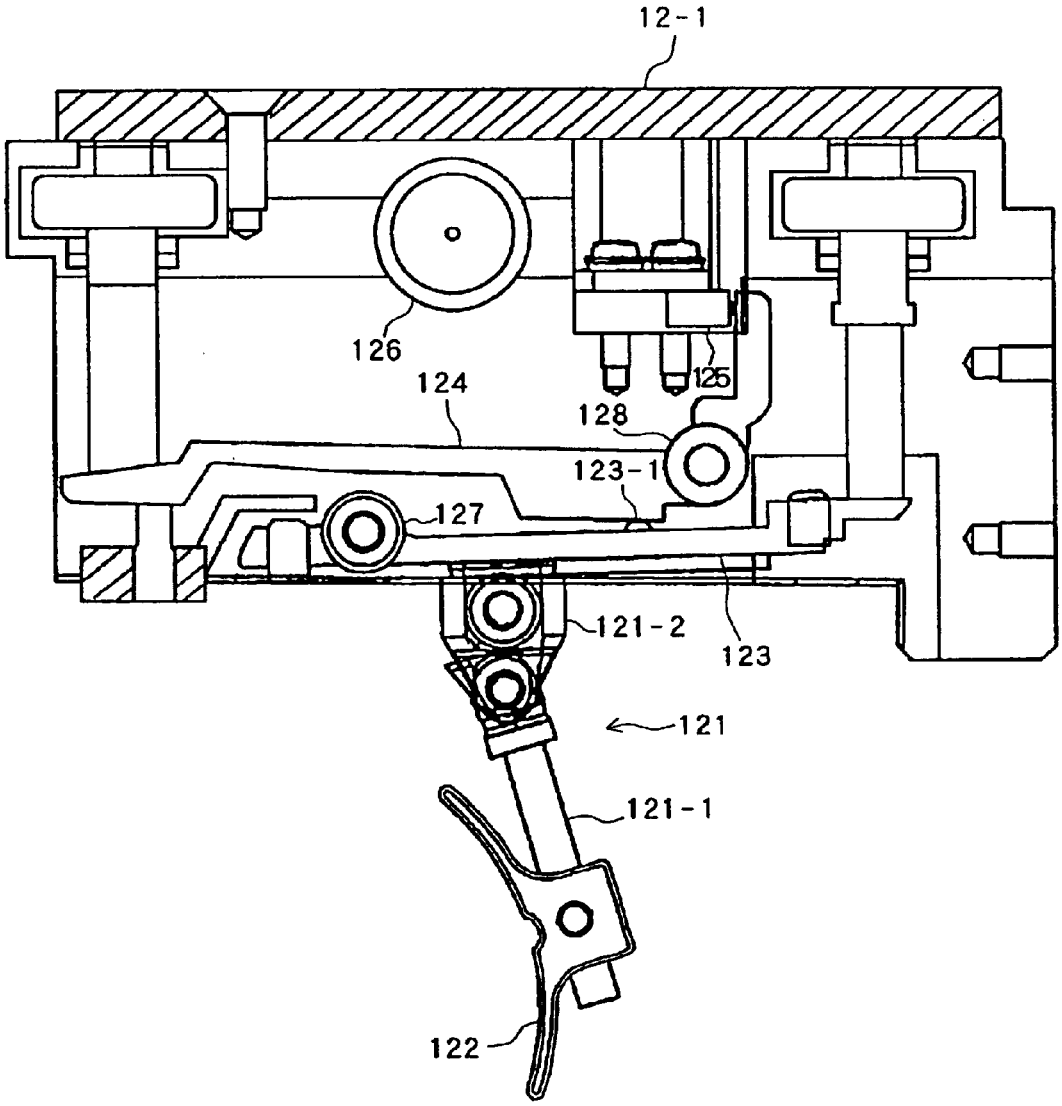
FIG. 3 is a cross-sectional view illustrating the mechanical structure of a frame.

FIG. 3 is a cross-sectional view illustrating the mechanical structure of frame 12. The cross-sectional view of FIG. 3 illustrates frame 12 viewed from one side of ray gun 1.

Referring to FIG. 3, frame 12 comprises first active lever 121, trigger blade 122, second active lever 123, passive lever 124, switch 125, and sound generator 126 inside or outside of frame housing 12-1. First active lever 121 comprises free end lever 121-1 and proximal end lever 121-2.

The trigger (trigger blade 122) is the portion manipulated by the player, such that the respective members operate in response to the manipulation.

In an initial state in which the trigger (trigger blade 122) is not pulled, switch 125 is pushed by passive lever 124 to remain in on-state.

As the player's finger applies a force on trigger blade 122, free end lever 121-1 rotates relative to proximal end lever 121-2. In response, second active lever 123 fixed to proximal end lever 121-2 rotates about shaft 127 in the counterclockwise direction, causing tab 123-1 to push up passive lever 124. Passive lever 124 pushed by second active lever 123 rotates about shaft 128 in the clockwise direction and moves away from switch 125, so that switch 125 turns off. The on/off state of switch 125 is communicated to light source 11 through a wire, not shown.

Figure 4:
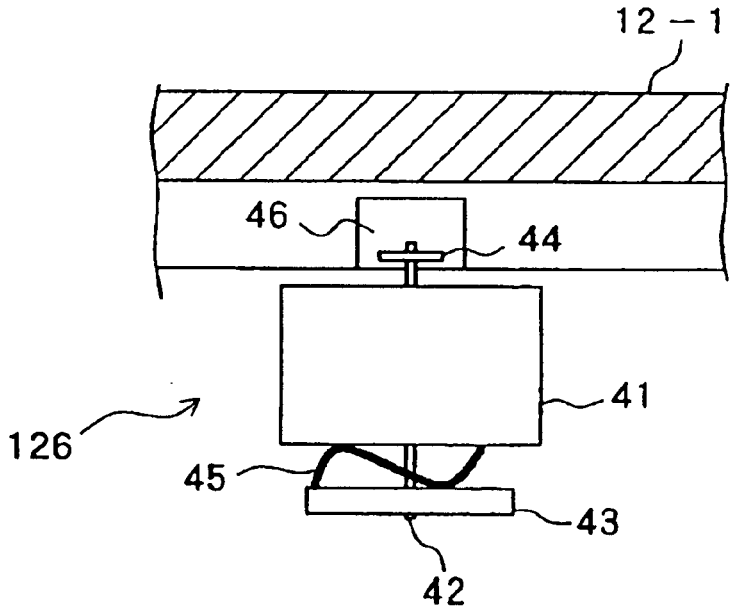
FIG. 4 illustrates a sound generator when viewed from above (from above in FIG. 3)
Figure 5:
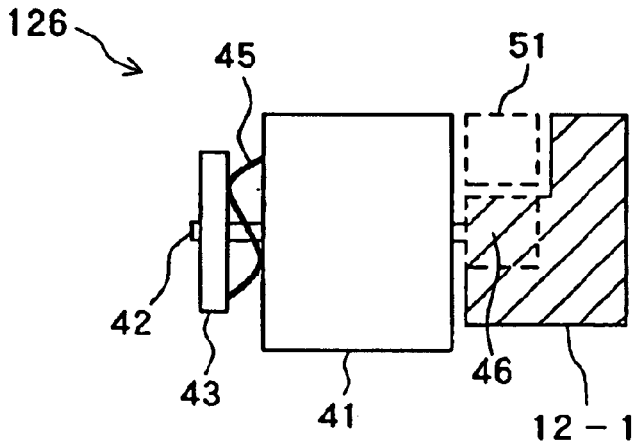
FIG. 5 illustrates the sound generator when viewed from a side (from the right in FIG. 3)

FIG. 4 illustrates sound generator 126 viewed from above (from above in FIG. 3), and FIG. 5 illustrates sound generator 126 from one side (from the right in FIG. 3).

Referring to FIG. 4, sound generator 126 comprises a solenoid, and has solenoid coil 41, solenoid shaft 42, impact member 43, stopper 44, and return spring 45.

Solenoid coil 41 is housed in a case, the diameter of which is larger than the length of solenoid shaft 42 in its operational direction, where the shaft is disposed such that its operational direction is perpendicular to the barrel of a gun, and the coil is supplied with a current which is controlled by controller 111. Solenoid shaft 42 extends through solenoid coil 41 and is movable by a magnetic force generated by solenoid coil 41. The solenoid used herein has the diameter larger than the length in the operational direction because this type of solenoid generates better sound than a solenoid which is longer in the operational direction. The sound or vibrations generated by the solenoid is only required to be perceivable by the player who operates ray gun 1. Excessively large sound could adversely affect other players. Also, excessively large vibrations would cause the player to move ray gun 1 out of the target, possibly missing the mark. Particularly, in training, it is necessary to distinctively analyze a variety of causes for missing the mark, such as whether the player wrongly aimed at the target, whether the player was affected by a movement after he had pulled the trigger, and the like. In a game, on the other hand, the sound generated by the solenoid is preferably distinguishable from sound generated when a live bullet is fired from a real gun.

Impact member 43, which is fixed at one end of solenoid shaft 42, impacts against the case of solenoid coil 41 by a movement of solenoid shaft 42, thereby causing the solenoid to generate sound and small vibrations which serve as recognition information for permitting the player to recognize that the trigger has been pulled. Stopper 44, which is fixed at the other end of solenoid shaft 42, restricts movements of solenoid shaft 42 to prevent solenoid shaft 42 from coming off solenoid coil 41. Return spring 45 resiliently returns solenoid shaft 42, which has been moved with a magnetic force, to the original position.

As illustrated in FIGS. 4 and 5, sound generator 126 is fixed in close proximity to frame housing 12-1. Then, frame housing 12-1 is provided with recess 46 for disposing solenoid shaft 42 and stopper 44 therein. Also, as illustrated in FIG. 5, groove 51 is formed between sound generator 126 and frame housing 12-1 for receiving a wire which connects controller 111 with switch 125 and sound generator 126.

Frame housing 12-1 should be in close proximity to sound generator 126 to such an extent that the wire does not fall in the gap therebetween, and they may be in close contact with each other. Frame housing 12-1 and sound generator 126 are preferably in close contact because the sound and vibrations generated by sound generator 126 are transmitted to frame housing 12-1. Also, recess 46 should be wide enough to prevent frame housing 12-1 from coming into contact with solenoid shaft 42 and stopper 44 even if they move, and should be narrow enough to prevent the wire from slackening and falling therein.

Figure 6:
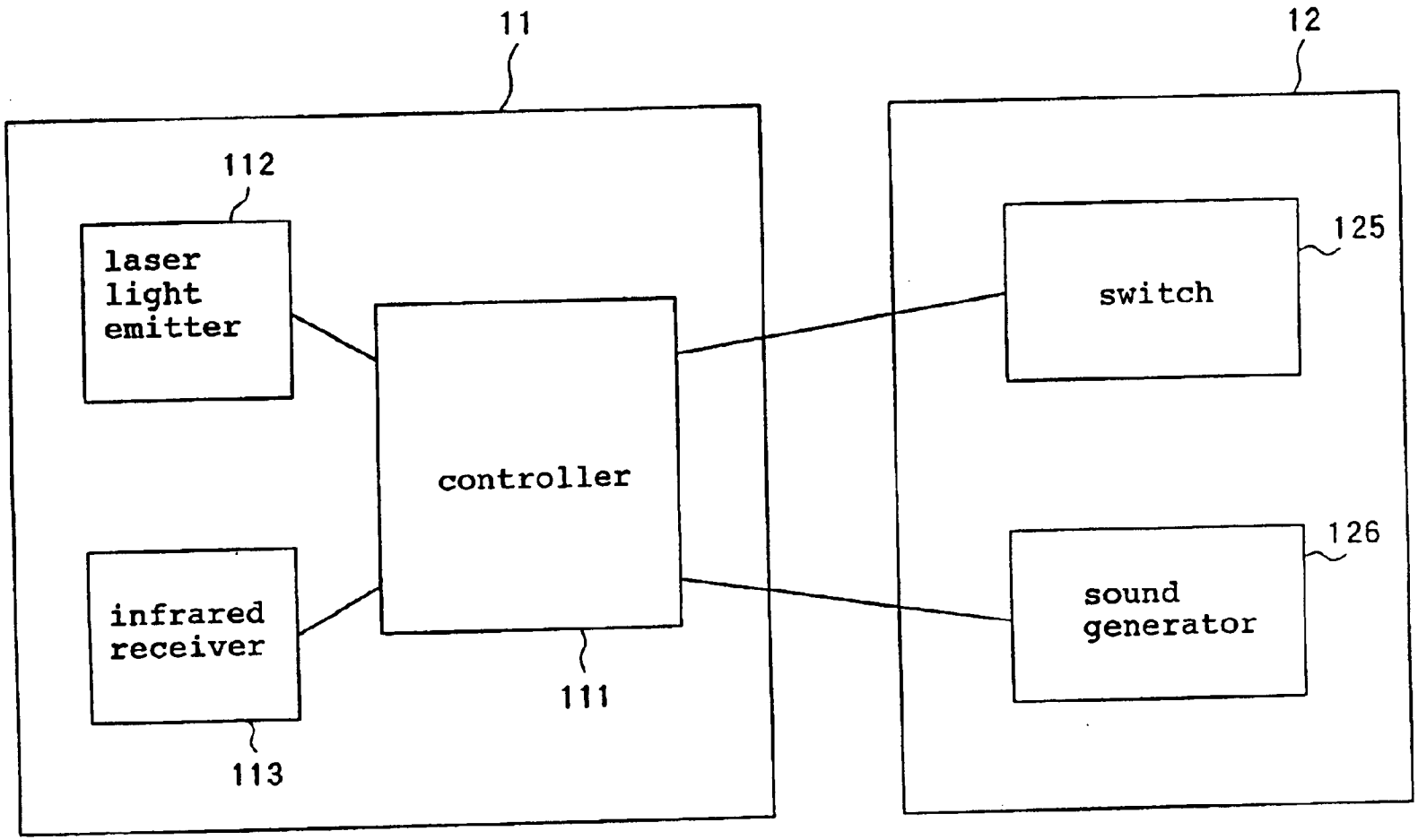
FIG. 6 is a block diagram illustrating an electrical configuration of a light source and the frame.

FIG. 6 is a block diagram illustrating the electrical configuration of light source 11 and frame 12. Referring to FIG. 6, light source 11 comprises controller 111, laser light emitter 112, and infrared receiver 113. Switch 125 and sound generator 126 included in frame 12, and laser light emitter 112 and infrared receiver 113 included in light source 11 are connected to controller 111.

Infrared receiver 113 receives an infrared signal sent from target device 2, and sends an extracted signal to controller 111.

Laser light emitter 112 performs an emitting operation in accordance with instructions from controller 111 to emit laser light. Signals carried on the laser light include, in addition to the aforementioned optical bullet, a pulse signal which is periodically sent for tracking the point at which ray gun 1 aims.

As solenoid coil 41 is applied with a current controlled by controller 111 in sound generator 126, impact member 43 impacts against the case of solenoid coil 41 to generate sound and vibrations.

Controller 111 controls laser light emitter 112 and sound generator 126 based on inputs from infrared receiver 113 and switch 125.

Figure 7:
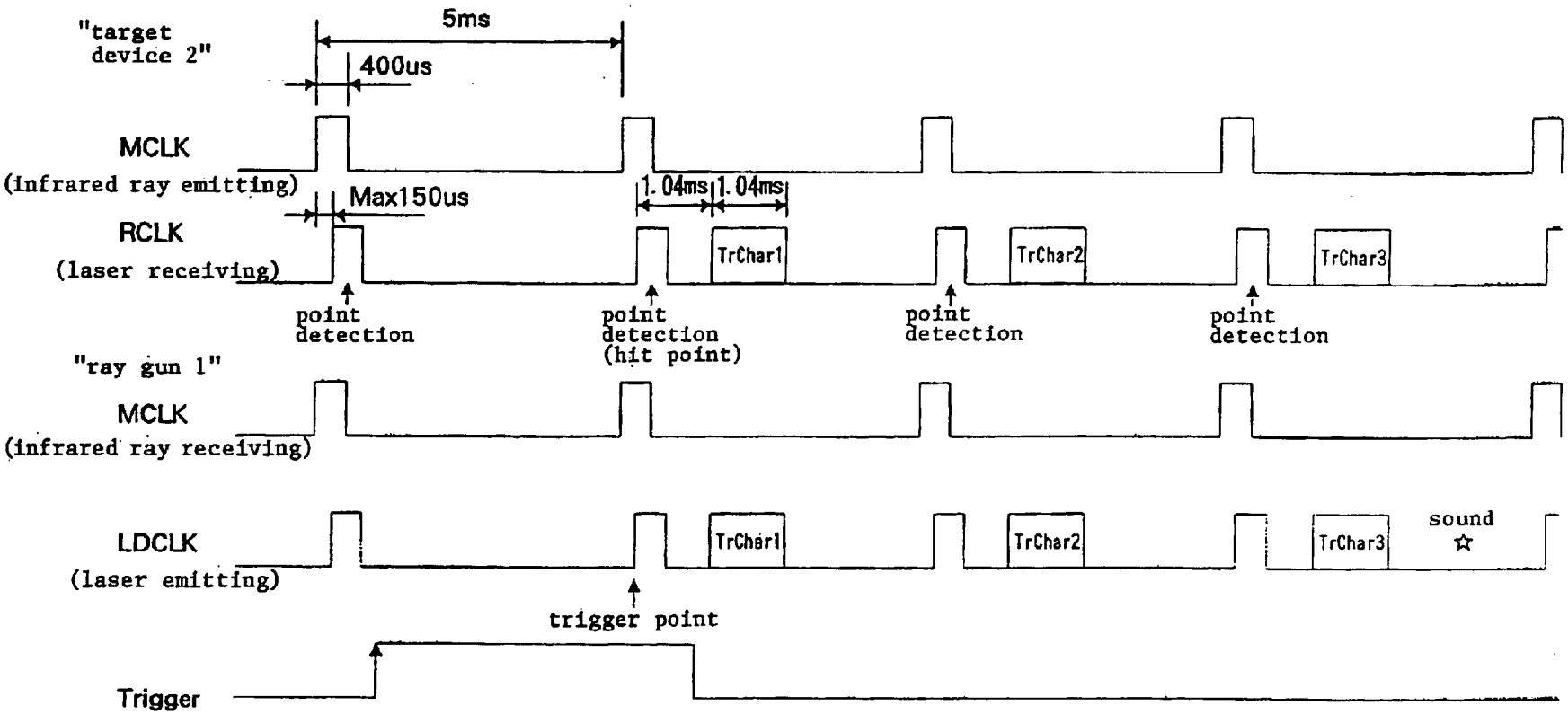
FIG. 7 is a timing chart representing the operation of the ray gun according to one embodiment of the present invention.

FIG. 7 is a timing chart representing the operation of ray gun 1 according to this embodiment. Referring to FIG. 7, target device 2 sends infrared timing signal MCLK. Timing signal MCLK is a pulse signal having a pulse width of 400 $\mu$sec, which is repeated at a cycle of 5 msec.

When ray gun 1 and target device 2 are placed opposite each other, infrared receiver 113 of ray gun 1 receives infrared timing signal MCLK. Infrared timing signal MCLK received by infrared receiver 113 is detected by controller 111.

As long as controller 111 is detecting infrared timing signal MCLK, ray gun 1 sends laser timing signal LDCLK irrespective of whether or not the trigger is being pulled.

When controller 111 is not detecting infrared timing signal MCLK, ray gun 1 does not send laser timing signal LDCLK even if the trigger is pulled. This is intended to prevent the player from emitting laser light from ray gun 1 to a person by mistake.

It should be noted that controller 111 of ray gun 1 internally generates timing signal LDCLK even if it does not detect infrared timing signal MCLK, but masks timing signal LDCLK so as not to emit an optical bullet in response. Even if ray gun 1 is not opposite target device 2, controller 111 controls sound generator 126 to generate sound if the trigger is pulled. For example, during a game or in intermission of the game, the player can give blank shots while confirming manipulations on the trigger with the aid of the sound and vibrations generated by sound generator 126.

Laser timing signal LDCLK is a pulse signal having the same repetition rate and pulse width as infrared timing signal MCLK. Laser timing signal LDCLK emitted from ray gun 1 is received at target device 2 as timing signal RCLK. Upon receipt of timing signal RCLK, target device 2 detects a point in the player sights of ray gun 1 in a pulse timing of timing signal RCLK when the receipt of a delay time from the sending of timing signal MCLK to timing signal RCLK is within 150 $\mu$sec. Target device 2 sends the detected aiming point to display device 3 in real time. Display device 3 records the aiming point received from target device 2 and displays the same in real time. In this way, display device 3 displays in real time a trajectory which reveals how the player is sighting ray gun 1 before he pulls the trigger to emit an optical bullet.

As the player now pulls the trigger (trigger blade 122) of ray gun 1, switch 125 turns off. The transition of switch 125 from ON to OFF (transition of trigger signal Trigger from "L" to "H") is detected by controller 111. As trigger signal Trigger changes from "L" to "H," controller 111 sends trigger characters (Tr Char 1–3) during intervals of pulses of laser timing signal LDCLK if controller 111 has detected timing signal MCLK.

Trigger characters Tr Char 1–3 provide three pulses of timing signal LDCLK with different characters, respectively. Three characters are sent from ray gun 1 to target device 2 indicating that the player has pulled the trigger of ray gun 1, with the intention to prevent a failure in reading the characters due to noise such as external light or to prevent erroneous recognition of external light as the characters. Each of the characters is sent within 1.04 msec in a timing delayed by 1.04 msec from timing signal LDCLK.

Trigger characters Tr Char 1–3 are detected by target device 2. On condition that at least two characters are detected from among the three characters, target device 2 recognizes a hit point as an aiming point which is detected at a timing pulse immediately before trigger character Tr Char 1 in timing signal RCLK, and communicates this information to display device 3.

Display device 3 records and displays the received hit point received from target device 2.

Next, controller 111 applies a current to solenoid coil 41 of sound generator 126 to generate sound and small vibrations from sound generator 126 before the next pulse timing after third trigger character Tr Char 3 has been sent. The sound generator 126 is driven after trigger characters Tr Char 1–3 have been sent because a large power consumption of the solenoid could disable controller 111 to send trigger characters Tr Char 1–3 after the sound and small vibrations have been generated from sound generator 126. The sound generated by sound generator 126 permits the player to recognize that an optical bullet has been emitted.

Generally, ray guns for games preferably operate with built-in batteries because cables connected to the ray guns would cause players to miss the mark, so that ray gun 1 of this embodiment is also powered by a built-in battery which may be contained, for example, in light source 11. However, a large power consumption is required to drive the solenoid, so that if the solenoid is actuated before the trigger characters are sent, the battery can be used up for driving the solenoid, resulting in a failure in sending the trigger characters. Alternatively, even if a large power consumption is not required for driving the solenoid, a small amount of remaining power in a battery could also disable controller 111 to send the trigger characters after the sound and vibrations have been generated. Ray gun 1 of this embodiment prevents such a failure in sending the trigger characters.

As described above, according to ray gun 1 of the foregoing embodiment, as switch 125 detects that the trigger has been pulled, a laser-based optical bullet is emitted from laser emitter 112 to target device 2, and the solenoid in sound generator 126 is driven to generate impact sound, thereby permitting the player to recognize that the optical bullet has been emitted.

Also, according to ray gun 1 of the foregoing embodiment, since the solenoid of sound generator 126 is driven after an optical bullet has been emitted from laser light emitter 112, sound generator 126 can generate the sound without fail in response to the emitted optical bullet.

Since the solenoid used in the ray gun 1 of this embodiment has the diameter larger than the length, sound generator 126 can generate highly perceivable sound which permits the player to clearly recognize the emission of an optical bullet.

Since the solenoid is disposed such that the operational direction of the associated shaft is perpendicular to the barrel, the solenoid larger in the diameter direction can be effectively contained in the housing, thereby making ray gun 1 compact.

Further, according to ray gun 1 of the foregoing embodiment, since impact member 43 is brought into impact against the case of solenoid coil 41 to generate sound and small vibrations, sound generator 126 is simple in placement and structure and is readily manufactured.

While the foregoing embodiment has shown an example in which three characters are sequentially sent as the trigger character, the present invention is not limited to three characters. Any number of characters may be sent as long as this will not cause erroneous detection or failure in detection.

Also, while ray gun 1 of the foregoing embodiment employs a solenoid which has the diameter larger than the length in the operational direction, a solenoid which has the length larger than the diameter may be used as long as it can generate good sound.

While preferred embodiments of the present invention have been described using specific terms, such description is for illustrative purposes only, and it is to be understood that changes and variations may be made without departing from the spirit or scope of the following claims.

What is claimed is:

1. A gun comprising:

manipulating means operated by an operator;

shooting means for performing a shooting operation in response to the operation of said manipulating means;

recognition information generating means for generating recognition information for permitting the operator to recognize that the manipulation of said manipulating means has been performed; and control means configured to detect the operation performed made by the operator on said manipulating means, and in response to the detected operation, to control said recognition information generating means whereby it generates said recognition information;

wherein said recognition information generating means comprises a solenoid, said recognition information generating means being responsive to a control signal from said control means to energize said solenoid, moving a shaft of the solenoid to cause first and second impact elements to impact one another, thereby generating said recognition information;

wherein said solenoid is in the shape of a cylinder which has a diameter larger than a length of the solenoid shaft measured along an axis of motion of the solenoid shaft;

wherein said solenoid is disposed such that the axis of motion of the solenoid shaft is perpendicular to a barrel of the gun.

2. A gun comprising:

manipulating means operated by an operator;

shooting means for performing a shooting operation in response to the operation of said manipulating means;

recognition information generating means for generating recognition information for permitting the operator to recognize that the manipulation of said manipulating means has been performed; and control means configured to detect the operation performed made by the operator on said manipulating means, and in response to the detected operation, to control said recognition information generating means whereby it generates said recognition information wherein said recognition information generating means comprises a solenoid, said recognition information generating means being responsive to a control signal from said control means to energize said solenoid, moving a shaft of the solenoid to cause first and second impact elements to impact one another, thereby generating said recognition information;

wherein said solenoid is in the shape of a cylinder which has a diameter larger than a length of the solenoid shaft measured along an axis of motion of the solenoid shaft;

wherein said recognition information generating means is disposed at least partially in close contact with a housing of said gun; and said housing comprises a recess for preventing said shaft from colliding with said housing by the action of said shaft.

3. The gun according to claim 2, wherein said housing further comprises a groove for receiving a wire therethrough to said recognition information generating means, said housing being in close contact with said recognition information generating means except for said recess and said groove.

4. A gun comprising:

manipulating means operated by an operator;

shooting means for performing a shooting operation in response to the operation of said manipulating means , wherein said shooting means emits an optical bullet formed of a light ray in response to a shooting operation;

recognition information generating means for generating recognition information for permitting the operator to recognize that the manipulation of said manipulating means has been performed; and control means configured to detect the operation performed made by the operator on said manipulating means, and in response to the detected operation, to control said recognition information generating means whereby it generates said recognition information;

a target signal receiver, constructed and arranged so as to receive a target signal sent from a target and generate a notification to said control means that said target signal is received so as to permit said gun to recognize that said gun is opposite said target, wherein:

said shooting means is prohibited from emitting the light ray and said recognition information generating means generates said recognition information upon detection of the operation of said manipulating means by said control means while said target signal receiver has not received said target signal; and said shooting means emits the light ray and said recognition information generating means generates said recognition information upon detection of the operation of said manipulating means by said control means while said target signal receiver has received said target signal.

5. The gun according to claim 4, wherein said control means, upon detection of the operation performed by the operator on said manipulating means, forces said shooting means to perform a shooting operation, and subsequently forces said recognition information generating means to generate said recognition information.

6. The gun according to claim 1, wherein said recognition information is sound or vibrations.

7. A gun comprising:

a trigger;

shooting means for performing a shooting operation in response to operation of said trigger by a user;

means for providing recognition information to the user as at least one of sound and vibration; and control means for detecting the operation of the trigger, and in response to the detected trigger operation, actuating the means for providing recognition information to the user;

wherein the means for providing recognition information for the user comprises a solenoid with a solenoid shaft arranged so that when the solenoid is energized, the solenoid shaft moves along a line perpendicular to a barrel of the gun.

8. The gun of claim 7, wherein the movement of the solenoid shaft causes first and second impact members to impact one another.

9. The gun of claim 7, wherein the solenoid is in the shape of a cylinder having a diameter that exceeds a length of the shaft measured along the line of movement of the shaft.

10. The gun of claim 7, further comprising:

a target signal receiver constructed and arranged to receive a target signal sent from a target and generate a notification to said control means that said target signal is received so as to permit said gun to recognize that said gun is opposite said target, wherein:

when the target signal receiver receives the target signal and the trigger is operated, the shooting means generates a light ray and the means for providing recognition information to the user energizes the solenoid; and when the target signal receiver does not receive the target signal and the trigger is operated, the shooting means does, not generate the light ray, but the means for providing recognition information to the user energizes the solenoid.

* * * * *